US007601082B2

(12) United States Patent
DiZazzo et al.

(10) Patent No.: US 7,601,082 B2
(45) Date of Patent: Oct. 13, 2009

(54) LACROSSE HANDLE

(75) Inventors: Steven DiZazzo, 3 Lexington Ave., Methuen, MA (US) 01844; Kevin Ryczek, 3 Quail Run Dr., Methuen, MA (US) 01844

(73) Assignees: Steven DiZazzo, Methuen, MA (US); Kevin Ryczek, Methuen, MA (US)

( * ) Notice: Subject to any disclaimer, the term of this patent is extended or adjusted under 35 U.S.C. 154(b) by 312 days.

(21) Appl. No.: 11/465,675

(22) Filed: Aug. 18, 2006

(65) Prior Publication Data

US 2007/0197316 A1 Aug. 23, 2007

Related U.S. Application Data

(60) Provisional application No. 60/709,230, filed on Aug. 18, 2005.

(51) Int. Cl.
*A63B 59/02* (2006.01)
*A63B 65/12* (2006.01)

(52) U.S. Cl. ..... 473/513; 473/422

(58) Field of Classification Search ..... 473/505, 473/512, 513, 422; D21/724
See application file for complete search history.

(56) References Cited

U.S. PATENT DOCUMENTS

| | | | | | |
|---|---|---|---|---|---|
| 4,101,125 | A * | 7/1978 | Heath | 473/552 |
| 5,169,145 | A * | 12/1992 | Jang | 473/552 |
| 5,356,235 | A * | 10/1994 | Brown et al. | 403/350 |
| 6,022,255 | A * | 2/2000 | Lukanovich | 440/101 |
| 6,033,325 | A * | 3/2000 | Hong | 473/552 |
| 7,367,858 | B2 * | 5/2008 | Matuska et al. | 440/101 |
| 2005/0075200 | A1 * | 4/2005 | Brine et al. | 473/513 |
| 2005/0079935 | A1 * | 4/2005 | Morrow et al. | 473/513 |
| 2005/0233839 | A1 * | 10/2005 | Adams et al. | 473/513 |
| 2007/0259742 | A1 * | 11/2007 | McCauley, Jr. | 473/513 |

* cited by examiner

*Primary Examiner*—Gene Kim
*Assistant Examiner*—M Chambers
(74) *Attorney, Agent, or Firm*—Grossman Tucker Perreault & Pfleger PLLC

(57) ABSTRACT

A shaft for a lacrosse stick includes two or more axially aligned portions that may be rotated independently of each other. Resistance to rotation provides exercise to strengthen the hands, arms and wrists of lacrosse players who use the stick.

1 Claim, 4 Drawing Sheets

LACROSSE HANDLE

RELATED APPLICATION

This application claims benefit of U.S. Provisional Patent Application Ser. No. 60/709,230, titled "LACROSSE HANDLE" and filed Aug. 18, 2005.

BACKGROUND

1. Field of Invention

The invention is related to lacrosse sticks and more specifically to lacrosse stick shafts or handles to improve strength and/or conditioning of athletes.

2. Discussion of Related Art

The game of lacrosse, both men's and women's, is played using a stick including a head and a shaft (handle). The head is typically triangular and includes mesh or other netting to form a pocket that is used to carry the lacrosse ball. The shaft is attached to the head and the player grips the shaft, usually with two hands, to throw, catch, shoot and cradle the ball. Players with stronger hands, arms and wrists can shoot faster and throw farther. Therefore, strengthening of these muscles can improve a player's skills. Lacrosse players may lift weights or do other common exercises to strengthen these muscles.

SUMMARY OF INVENTION

The subject matter of this application may involve, in some cases, interrelated products, alternative solutions to a particular problem, and/or a plurality of different uses of a single system or article.

In one aspect, a lacrosse stick shaft is provided, the shaft comprising a first substantially tubular portion including a first end constructed and arranged to mate with a lacrosse stick head, and a second substantially tubular portion connected to the first tubular portion and being rotatable with respect to the first substantially tubular portion about a common axis.

In another aspect, a method of making a lacrosse stick shaft is provided, the method comprising connecting a first tubular portion to a second tubular portion with a connector that provides for axial rotation of one tubular portion in relation to the other tubular portion.

In another aspect, a method of using a lacrosse stick is provided, the method comprising grasping a first portion of a lacrosse stick shaft with a first hand, grasping a second portion of the lacrosse stick shaft with a second hand, and axially rotating the first portion in relation to the second portion.

DETAILED DESCRIPTION

Figure 1:
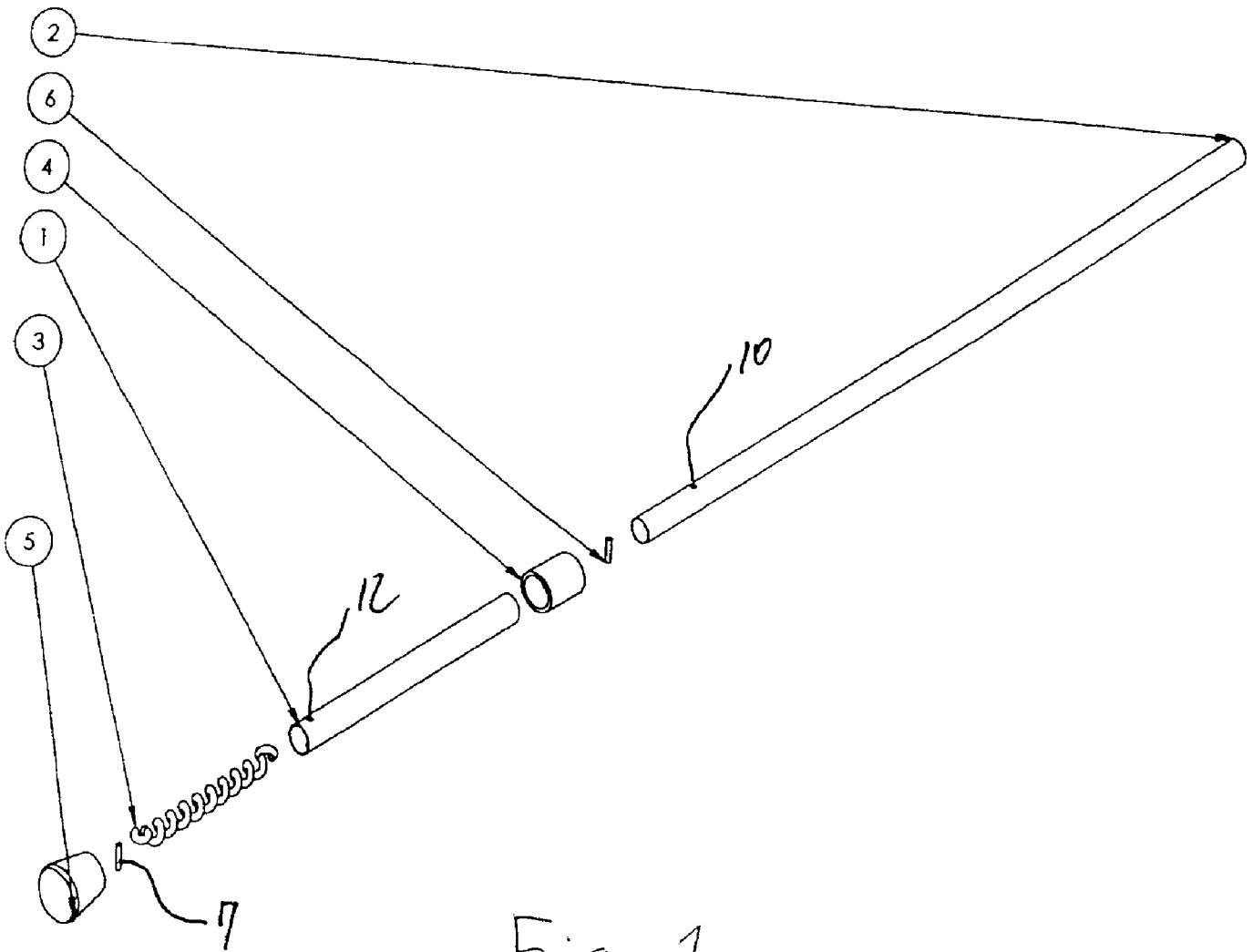
FIG. 1 shows an exploded view of parts that may be used to make up a lacrosse shaft.

"Substantially tubular portion" means a shaft or portion of a shaft. It may be hollow but need not be. In cross-section, the substantially tubular portion may be regular or irregular and may be, for example, round, oval, polygonal, hexagonal, octagonal, etc. The portion may change in shape or size along the length of the portion or may be constant along its length.

In one aspect the invention is directed to a device for improving arm and wrist strength of lacrosse players. The device may look much like a conventional lacrosse stick, including a shaft and a head. Instead of the unitary shaft used in standard lacrosse sticks, the device may have a shaft that includes at least two distinct portions that may be independently rotatable in relation to one another. For example, the upper part of the shaft, connected to the head, may be held stationary in the right hand and the lower part of the shaft, held in the left hand, may be rotated about an axis passing through the shaft. The two portions may be connected by a rotatable connector that retains the two portions while allowing independent rotation. Third and additional portions may also be used.

In many embodiments the invention can be used either left- or right-handed. The lacrosse player may hold the bottom end of the shaft stationary with one hand while rotating the top portion of the shaft with the other hand in a clockwise or counter-clockwise motion. Similarly, the player may chose to rotate the bottom portion of the shaft while holding the top portion stationary. The player can even rotate both ends of the shaft in opposition directions. All of these motions may be similar to the motions a lacrosse player would use while "cradling" a lacrosse stick. Repeated rotation of the shaft can develop hand, arm and wrist strength. As the two portions may be connected by a rotatable connector, the two portions of the stick can be held in place as one piece. Furthermore, with a lacrosse stick head installed, the device can be used to catch and throw a lacrosse ball similar to a conventional lacrosse stick.

In another aspect, the invention is related to a two-piece lacrosse stick shaft. The two pieces may be substantially tubular portions aligned axially to form the completed shaft. The portions may be cylindrical, oval, polygonal or irregular in cross section and may be solid or hollow. It may be preferable that the portions are hollow tubes in order to reduce weight. The two portions of the shaft may be able to rotate independently of each other about a common axis passing substantially longitudinally through the center of each portion. The upper portion is typically fixed to the lacrosse stick head using conventional means known to those skilled in the art. The two portions are rotatably joined to each other so that the player can hold one portion with one hand and rotate the other portion with the other hand. The portions may be painted, powder coated, or otherwise finished.

In some cases, both portions may be rotated simultaneously in opposite directions. Once the player stops applying a force, the portions resiliently return to their original orientations. Thus, the rotatable connector may be constructed and arranged to bias the portions of the stick in a first position. A resistance is employed to provide an opposing force to the player's twisting motion. This resisting force may be adjustable and can be varied for different players. The resisting force may be constant throughout the range of movement or may increase or decrease as the user progresses through the range of movement. The work that the player's wrists, hands and/or arms must do to overcome this resistance provides the strengthening exercise for the player.

The twisting motion may be repeated as many times as desired and may be used when playing lacrosse or when not playing the game. Coaches may devise specific drills using the rotatability of the stick. The stick may be used to catch, throw, shoot and cradle just as with any conventional lacrosse stick. While in some cases the stick might not be allowed in games it can be used in practice, allowing the player to strengthen his or her muscles while waiting for drills, running laps, etc. If desired, the shaft can include a "lock-out" that, when engaged, prevents the two portions of the shaft from rotating, securing the two portions of the shaft in a fixed position.

The two portions of the shaft may be attached and/or aligned by a collar that can be either internal or external of the shaft portions. A bushing may be used between the two portions to aid in smooth rotation. The portions may be held together by a resilient connector such as a spring. The spring may be of any suitable material, such as aluminum, steel, polymer or alloy. One or both ends of the spring may be held in corresponding shaft portions by a pin that may pass through the cross-section of each portion. The pins may be metal or plastic, for example. If the spring is in tension it can also serve to pull the two portions toward each other helping to prevent the two portions from being bent out of alignment when a shooting or passing force is applied by the player. An outer or inner sleeve may also be helpful in keeping the two portions axially aligned.

The resilient piece may be a spring with its helical axis oriented parallel to the axis of the shaft. Coils may also be used and may be circumferentially aligned with the walls of the shaft portion. Elastomers and other resilient materials may also be used to provide a resisting force to the twisting motion applied by the player. For example, a rubber elastomer having a durometer of 60 has been found to provide appropriate tension for strengthening exercises. The elastomer may include a hole passing through one or both ends to aid in fixing the elastomer to each shaft portion. An insert such as a PEMSERT may be inserted in each hole in the elastomer and a screw may then be inserted through the shaft portion into the insert.

In some cases, different levels of tension may be desired. Rotation resistance may be adjusted in several ways. For instance, springs or elastomers of differing tensions may be used. Adjustments may also be made as to the amount of tension applied to the resilient piece. For instance, the resilient member may be pre-loaded to a different degree for different tension requirements. In addition, different length elastomers or springs may also provide different levels of tension.

The twisting range of the two portions may be limited and one of the portions may not be able to rotate infinitely in relation to the other. Rotatable range may be limited to less than 360 degrees, less than 180 degrees or less than 90 degrees.

The ends of the portions of the shaft may be circular in cross-section to facilitate the rotation of the shaft in the sleeve or around the sleeve. One portion may have an outer diameter essentially the same size as the inner diameter of the other portion. This allows one portion to be positioned at least partially concentrically within the other. The thinned portion may optionally extend inside the entire length of the thicker portion. With various bushings and connectors, non-circular cross-sectional shapes can be used. Of course, the outer wall of one or both portions may be of a different cross-section than the inner wall. For example, the inner wall may be circular and the outer wall polygonal. A substantially or partially polygonal outer wall can be formed to mimic the polygonal shafts that are typically used in present day lacrosse sticks. This same effect can be realized by sliding a polygonal sleeve over a tubular portion or portions. The sleeve can be fixed to the tubular portion.

In some embodiments the portions of the shaft may be made out of materials that are used to make conventional lacrosse shafts. Materials may include, for example, metals, polymers, and/or alloys. These can include, for example, aluminum, titanium, stainless steel, zinc alloy, carbon, reinforced carbon, fiberglass reinforced plastic, PVC, polycarbonate, polyethylene, and polypropylene. The two portions may be of similar or dissimilar materials.

FIG. 1 shows an exploded view of parts that may be used to make up one embodiment of the shaft. A first tubular portion 1 may be of a thinner diameter than is second tubular portion 2 so that the second tubular portion can slide into and be aligned by the first tubular portion. The ends of resilient spring 3 may be affixed to each tubular portion by pins 6 and 7 respectively which may pass through holes 10 and 12 respectively. Collar 4 may be placed around the junction of the two tubes 1 and 2 and can hide hole 10 as well as protect the user from any pinching that might occur at the tube junction when they are rotated. Collar 4 may be made of, for example, plastic or rubber. Collar Holes 10 and 12 are used to secure pins 6 and 7 which in turn retain spring 3 so that when tube 2 is rotated in relation to tube 1 the spring is forced to twist as well, providing a resistant force. The force can be chosen by picking a specific spring exhibiting a specific resistance. Cap 5 serves its common purpose on a lacrosse stick and can also serve to hide through hole 12 and any part of pin 7 that may protrude. The cap may be composed of, for example, plastic or rubber. As shown, the upper right portion of the shaft may be connected to a lacrosse stick head to make a complete lacrosse stick. Connection of a head may be done in a conventional manner, such as by fitting the head to the shaft and securing it with a screw. The end of shaft portion 2 may be shaped to conform to the receiver of a conventional lacrosse head.

Figure 2:
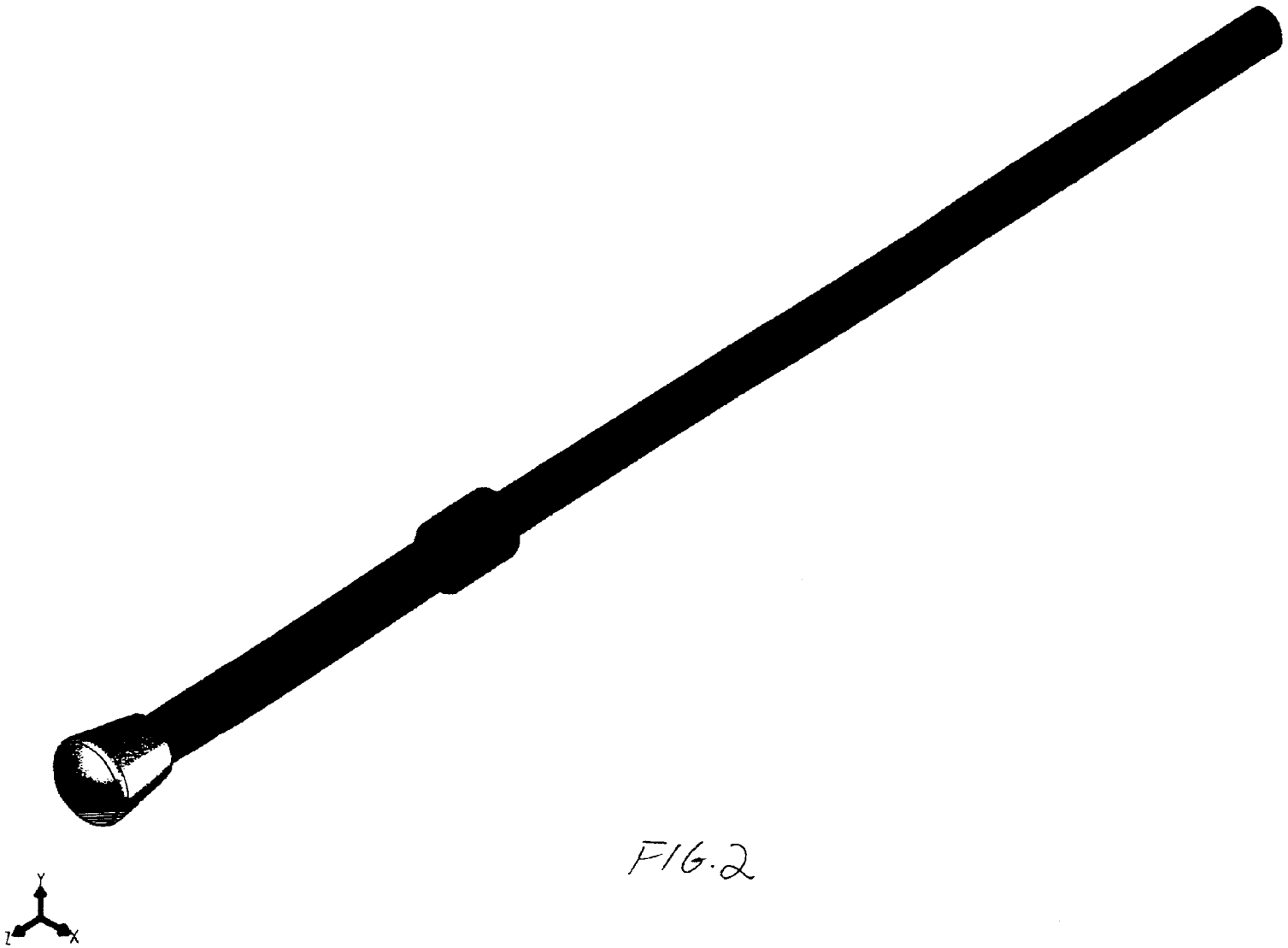
FIG. 2 provides a plan view of an assembled lacrosse shaft.
Figure 3:
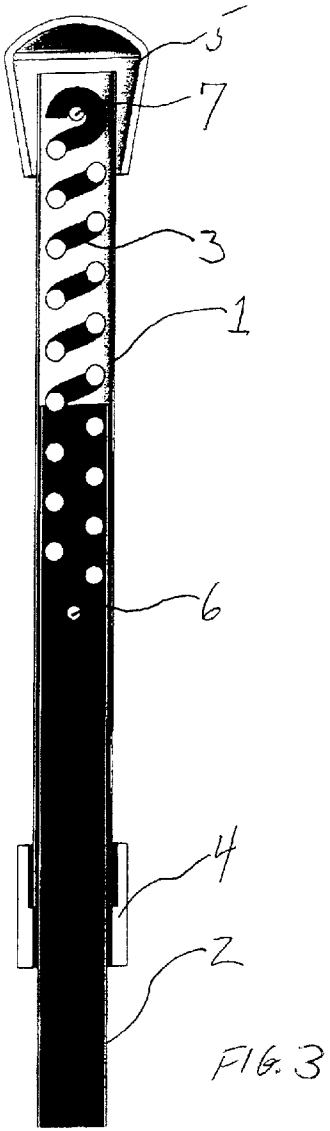
FIG. 3 provides a cutaway view of a portion of a lacrosse shaft.
Figure 4:
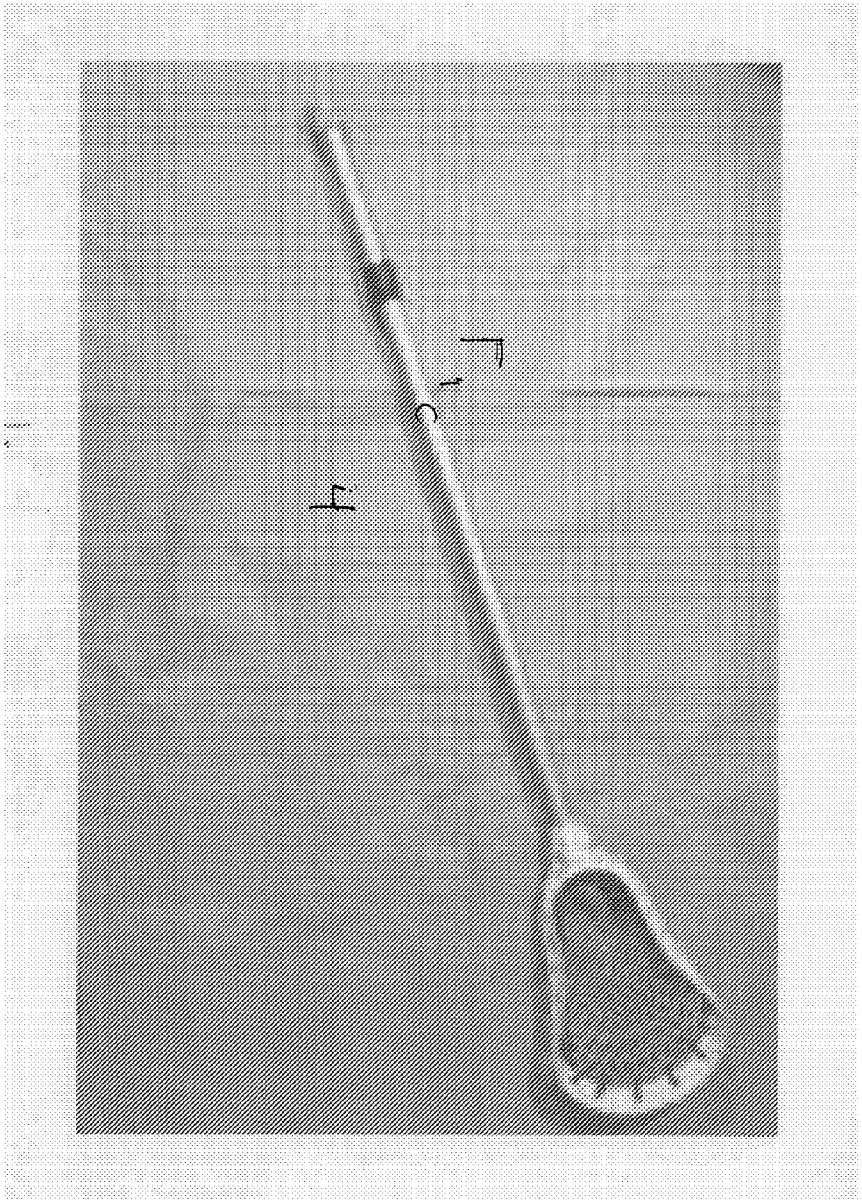
FIG. 4 is a photograph of a lacrosse stick incorporating one or more aspects of the invention.

An example of an assembled shaft is provided in the scan shown in FIG. 2. FIG. 3 provides a cut-away view of an assembled shaft showing the same components as shown in FIG. 1, but in their completed form. FIG. 4 shows a finished lacrosse stick, including the head and the shaft described above.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications and publications that are cited or referred to in this application are incorporated in their entirety herein by reference.

What is claimed is:

1. A method of for a lacrosse player to strengthen arm muscles by using a lacrosse stick, the method comprising the steps of:

1) providing a lacrosse stick comprising:

a first substantially tubular portion including a first end constructed and arranged to mate with a lacrosse stick head; and a second substantially tubular portion connected to the first tubular portion by a resilient connector formed of aluminum, steel, polymer or an alloy and being rotatable with respect to the first substantially tubular portion about a common axial axis; wherein the resilient connector allows for twisting of the second substantially tubular portion in relation to the first substantially tubular portion while providing a biasing force that returns the two portions to their original position after a twisting force has been removed, 2) grasping a first portion of a lacrosse stick shaft with a first hand;

3) grasping a second portion of the lacrosse stick shaft with a second hand, the second portion axially aligned with the first portion and in a first position with regard to the first portion;

4) axially rotating the first portion in relation to the second portion from the first position to a second position, the rotation being opposed by the resistant connector force;

5) allowing the first and second portions to resiliently return to the first position by stopping the application of the rotating force; and 6) throwing and catching a lacrosse ball with the lacrosse stick.

* * * * *